US006637048B1

(12) United States Patent
Lorch et al.

(10) Patent No.: US 6,637,048 B1
(45) Date of Patent: Oct. 28, 2003

(54) SANITARY FITTING

(75) Inventors: Werner Lorch, Schramberg (DE); Chris Marshall, Cumming, GA (US)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 09/532,608

(22) Filed: Mar. 22, 2000

(30) Foreign Application Priority Data

Mar. 26, 1999 (DE) ..... 199 13 705

(51) Int. Cl.[7] ..... A47K 3/22
(52) U.S. Cl. ..... 4/615; 4/596; 4/601; 4/612
(58) Field of Search ..... 4/596, 601, 600, 4/605, 612, 613, 614, 615, 567, 676, 677; 137/359, 360

(56) References Cited

U.S. PATENT DOCUMENTS

| | | | | | |
|---|---|---|---|---|---|
| 1,835,301 | A | * | 12/1931 | Hennessey | 137/597 |
| 2,847,027 | A | * | 8/1958 | Kumpman | |
| 3,176,924 | A | * | 4/1965 | Canavan | 137/580 |
| 3,292,185 | A | | 12/1966 | Lucian | 4/145 |
| 3,333,284 | A | * | 8/1967 | Symmons | 4/615 |
| 3,761,967 | A | | 10/1973 | Owings | 4/192 |
| 4,457,031 | A | * | 7/1984 | Moore | |
| 4,654,900 | A | * | 4/1987 | McGhee | 4/661 |
| 4,685,156 | A | * | 8/1987 | Brabazon | 137/597 |
| 5,365,620 | A | * | 11/1994 | MacLeod | 4/600 |
| 5,678,258 | A | * | 10/1997 | Healy | 4/601 |
| 6,038,715 | A | * | 3/2000 | Flieger et al. | 4/601 |
| 6,256,808 | B1 | * | 7/2001 | Graham et al. | 4/567 |
| 6,279,604 | B1 | * | 8/2001 | Korb et al. | 137/359 |

FOREIGN PATENT DOCUMENTS

| | | |
|---|---|---|
| DE | GM 69 00 887 | 1/1969 |
| DE | OS 22 16 089 | 10/1973 |
| DE | 32 37 419 A1 | 4/1984 |
| DE | 89 02 255 U1 | 6/1989 |
| DE | 41 25 569 | 3/1992 |
| DE | 195 42 748 | 5/1997 |
| EP | 0 422 972 | 4/1991 |
| EP | 0 590 960 | 4/1994 |

OTHER PUBLICATIONS

Literature: IKZ, 11/96, S.59–63 (PHARO Hansgrohe).

* cited by examiner

*Primary Examiner*—Gregory L. Huson
*Assistant Examiner*—Khoa Huynh
(74) *Attorney, Agent, or Firm*—Duane Morris LLP

(57) ABSTRACT

A sanitary fitting such as a wall-mounted installation for a shower area, has a common housing and a rosette or cover plate. The housing and rosette associate control and flow components, including a shower discharge element at the rosette. The shower discharge element, for example, is constructed as a lateral shower that delivers water through the rosette. The fitting has operating or control elements, and in addition to the shower discharge element at the rosette, leads to another discharge outside the housing and outside the rosette, i.e., apart from the fitting.

11 Claims, 2 Drawing Sheets

SANITARY FITTING

BACKGROUND OF THE INVENTION

The invention concerns a compact sanitary fitting disposed behind a rosette.

Numerous different sanitary fitting constructions are known. There are thermostatic valves, mixing valves and multiway valves. Sanitary fittings are frequently constructed as concealed fittings, which are housed in recessed manner in an opening of a wall. The actual fitting is then e.g. covered with a rosette through which the fitting can be controlled. This means that e.g. in the case of a thermostatic valve the temperature and quantity of the mixing water can be adjusted using operating elements or controls on the rosette.

An object of the invention is to further develop a sanitary fitting with respect to a compact structure, an ease of operation and with regards to design possibilities For the first time the invention proposes a fitting in which a flow of water also passes through the rosette, in that e.g. a lateral shower delivers its water through the rosette. All the sanitary fitting elements necessary for the use of the fitting can be used through the rosette. These e.g. include the actuating element for the mixing valve, as well as a shower-flow element, which is naturally also necessary for the use of the fitting.

The at least one shower-flow element provided according to the invention can e.g. be directly retained or fixed in the rosette, so that the latter assumes a further function.

According to the invention the at least one shower-flow element can be connected by means of a line with the fitting housing or a fitting main body. It can comprise one or both of a rigid line of tubular material and also a hose.

At least one shower-flow element is fitted to the fitting housing, the water supply e.g. taking place through an inner duct of the fitting housing.

According to another further development of the invention the operating elements of the sanitary fitting include a reversing valve, which is also operable through the rosette.

According to the invention the mixing valve can be a thermostatic valve on the fitting housing for temperature control, coupled to a cold water inlet and a hot water inlet. In this case both the temperature and quantity of the mixing water can be adjusted through the rosette.

According to the invention the mixing valve can be a single-lever mixing valve.

The invention proposes that all the components of the fitting are located in a fitting housing, so that the elements are combined as a structural unit. The rosette can then e.g. be fixed to said fitting housing. It is also possible to fix the rosette to the wall.

It is also possible for the components to be placed as separate components in a main body. It is obviously also possible for the individual components to be juxtaposed as individual parts, the rosette covering all these parts. The rosette here serves as a combining component.

According to the invention all the components are interchangeable.

The sanitary fitting can be constructed as a concealed fitting. In this case the rosette can be substantially planar, so that it rests on the surface of the wall in which the fitting is housed in recessed manner.

It is also possible to construct the fitting as a surface fitting, when the rosette has a dome-like construction.

According to the invention the reversing valve can be constructed in such a way that, as desired, at least one shower-flow element and/or another outlet of the fitting is supplied with water, which leads to a discharge opening outside the fitting.

According to a further development of the invention the rosette has a water passage, i.e. is constructed in such a way that water partly flows through it without a different component being used for this purpose. For example, in the rosette can be provided a recess in which a laterally-aimed shower-flow element or shower head is inserted from the outside. On the inside or back the said recess can have a connection possibility, which is e.g. connected with the aid of a hose to the mixing valve.

The rosette can form part of a shower head, so that it is merely necessary to additionally insert a flow element such as a shower forming disk.

DETAILED DESCRIPTION OF PREFERRED EMBODIMENTS

Figure 1:
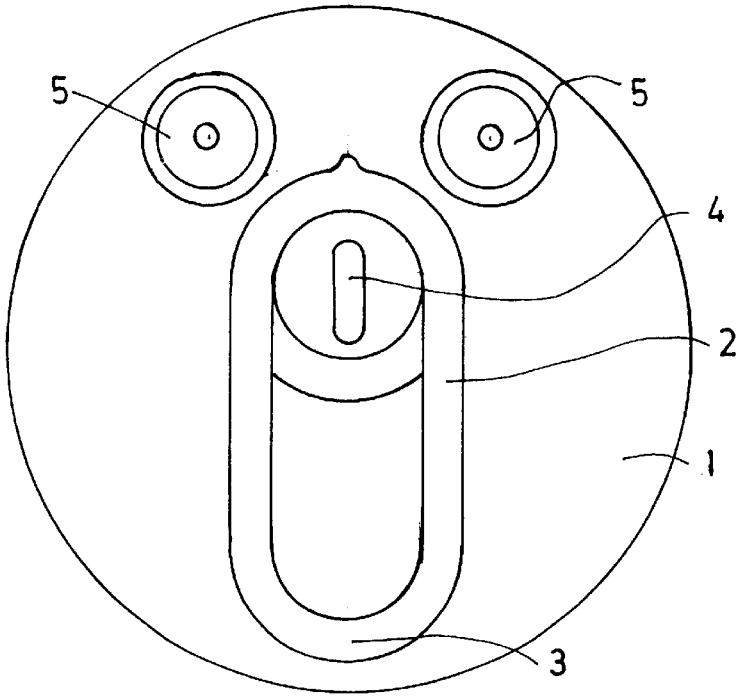
FIG. 1 is a view of the fitting from the user side.

The front view of FIG. 1 shows an e.g. circular rosette 1, in whose central part is located a clip 2, which constitutes a reversing element, which can be swivelled clockwise and counterclockwise. It can simultaneously be swivelled in another way, in that the lower part 3 of the clip 2 in the drawing is removed from the rosette and then again moved towards it.

Roughly in the center of the rosette 1 is provided a second control member 4 in the form of a toggle, which can also be swivelled clockwise or counterclockwise. It can be a control element for the temperature of a thermostatic valve.

Symmetrically to a longitudinal median plane in the vicinity of the upper edge are provided two shower-flow elements 5, which can in each case e.g. be a laterally aimed shower head. By twisting the clip 2 it is possible to switch on the lateral showers 5 or to direct the flow otherwise, around them.

Figure 2:
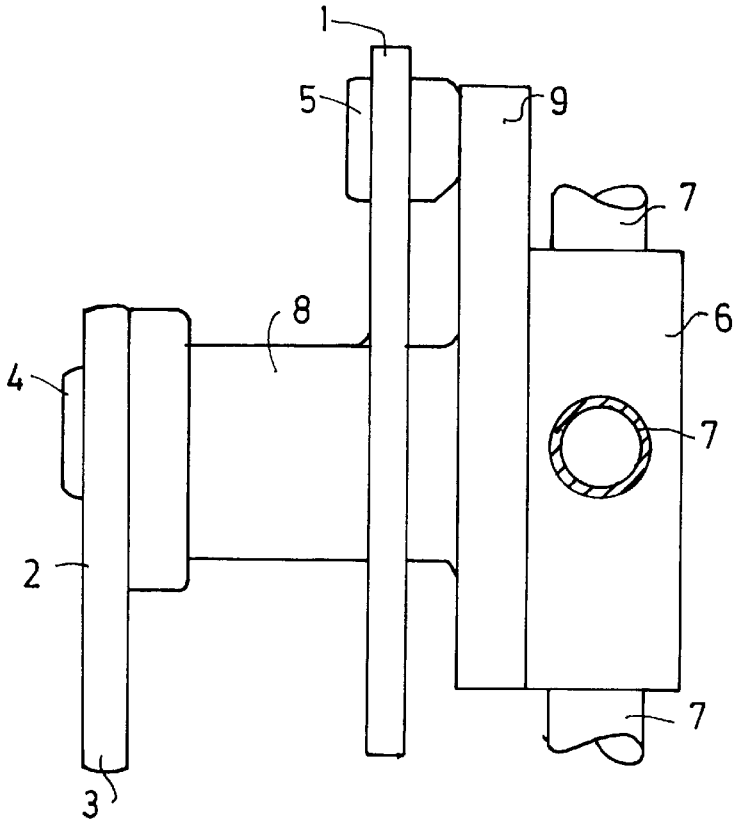
FIG. 2 is a diagrammatic side view of a fitting proposed by the invention.

FIG. 2 shows the arrangement from the side. The sanitary fitting contains a fitting main body 6 into which several lines 7 issue. For example, into the main body 6 issue two inlet lines, whereof one is intended as a cold water inlet and the other for hot water. Two further lines 7 can lead temperature-controlled mixed water out of the fitting, e.g. to a head shower and a shower hose.

The fitting main body 6 contains in a lug 8 the aforementioned thermostatic valve and the reversing valve, which can be controlled or operated by the toggle 4 or clip 2. The lug 8 passes through an opening in the rosette 1.

The rosette 1 also contains the two lateral shower-flow heads for laterally aimed showers 5, which are fitted to a part 9 of the fitting main body 6. Said part 9 can house water passage to the lateral showers 5. The reversing valve, which is operated by the clip 2, can be constructed in such a way that as a function of the position one or both lateral showers 5 or also the head shower 8 can be supplied with water.

The rosette 1 is constructed in such a way that it covers all the parts of the fitting, but still permits access to all parts necessary for use.

Figure 3:
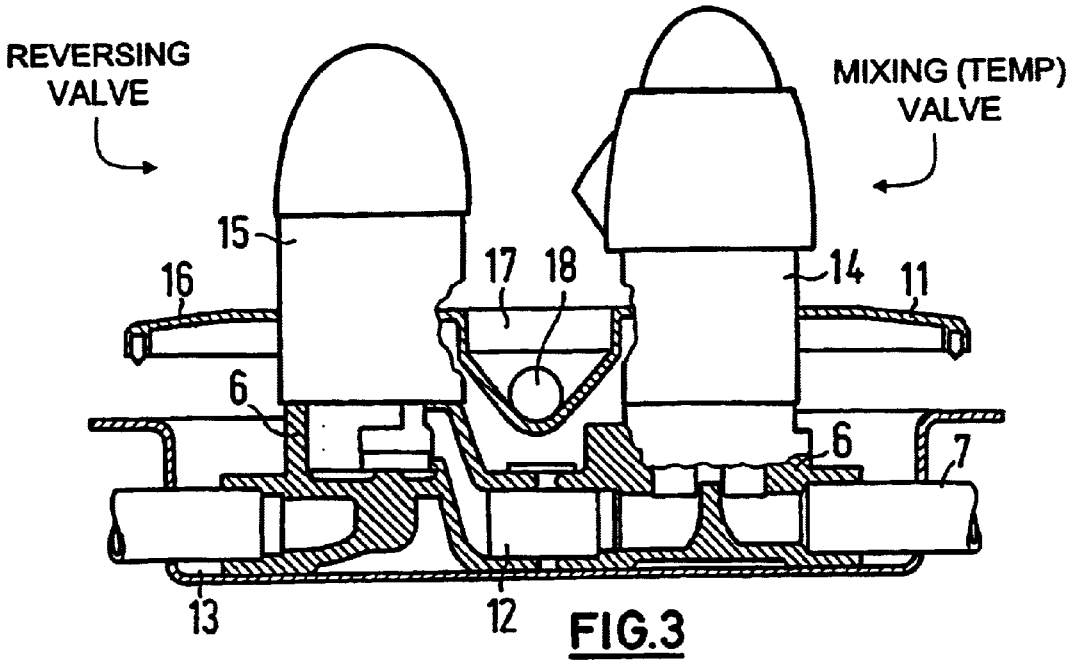
FIG. 3 is a longitudinal section through a second embodiment.

FIG. 3 is a longitudinal section through an arrangement wherein two fitting main bodies 6, which are interconnected by a short pipe piece 12, are placed in a concealed box 13. One of the two fitting main bodies 6 contains a temperature control valve 14. The other fitting main body contains a reversing valve 15. Both valves project through corresponding openings of the rosette 11, which as is shown in the example has an oval or elliptical construction.

Figure 4:
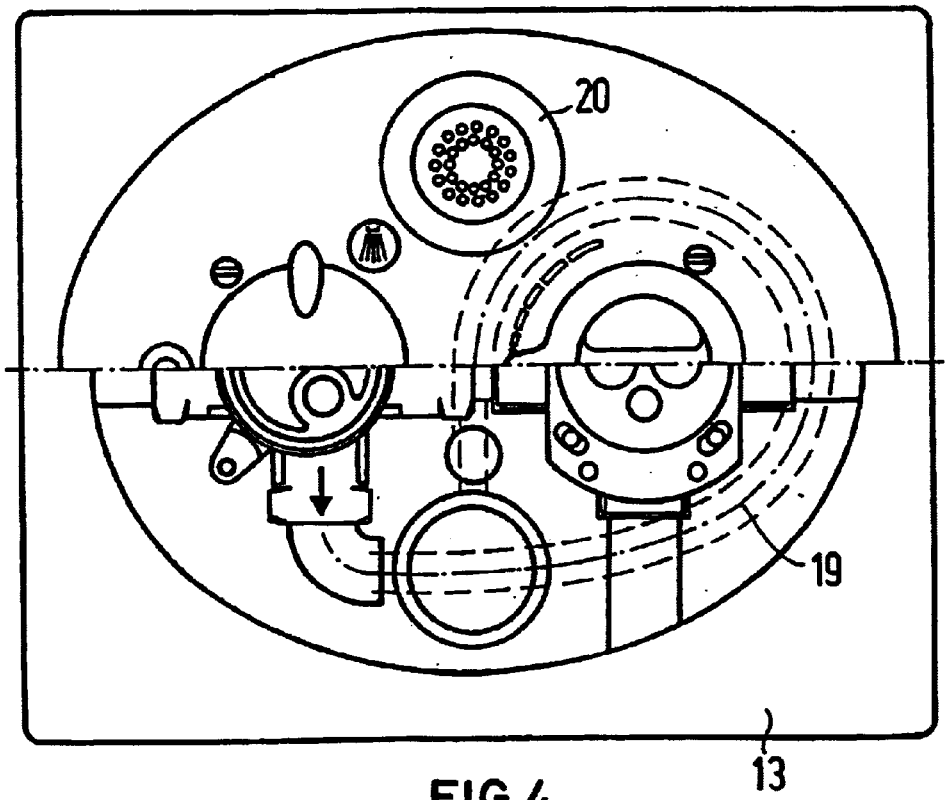
FIG. 4 is a plan view of the arrangement of FIG. 3 from above, with a partly removed rosette.

The rosette 11 contains, on a line which roughly corresponds to the short axis of the ellipse, in each case one recess 17 emanating from the outside 16 at the top in FIG. 3. In the vicinity of its opening, said recess 17 is constructed as a shallow cylinder and then passes into a tapering part. Onto said tapering part is shaped a connecting piece, which has a circular opening 18. To the connecting piece is connected a hose 19 (compare the diagrammatic representation at the bottom of FIG. 4). The hose 19 comes from the reversing valve 15 and serves to lead the water from thermostatic valve to the recess 17. In said recess 17 can be inserted from the outside a lateral shower 20, which is shown in the upper half of FIG. 4. The recess 17 forms part of the lateral shower and e.g. forms the mounting support of the laterally aimed shower, which can optionally also be swivelled.

What is claimed is:

1. A sanitary fitting having a fitting housing;

a mixing valve on the fitting housing for temperature control, coupled to a cold water inlet and a hot water inlet and a control arranged for operation of the mixing valve, at least one shower-flow element coupled to a first outlet of the mixing valve, wherein the mixing valve and the at least one shower-flow element provide operating elements necessary for using the sanitary fitting, including the mixing valve and the shower-flow element, and are supported on the fitting housing;

a rosette, which covers the fitting housing entirely but for passages through the rosette for said operating elements supported on the fitting housing and necessary for using the sanitary fitting;

wherein said at least one shower-flow element is mounted to be one of on the rosette and in the rosette; and, wherein the fitting also leads to an other outlet that has a discharge opening outside the fitting, apart from the housing and the rosette.

2. The sanitary fitting according to claim 1, wherein the at least one shower-flow element comprises a shower head directed laterally from the rosette.

3. The sanitary fitting according to claim 1 or 2, wherein the at least one shower-flow element comprises a line connected through the rosette to the mixing valve on the fitting housing.

4. The sanitary fitting according to claim 1, wherein one of said operating elements comprises a reversing valve operable through the rosette.

5. Sanitary fitting according to claim 4, wherein the reversing valve is constructed for selectively directing water to at least one of the shower element and another outlet of the fitting, which leads to a discharge opening outside the fitting.

6. The sanitary fitting according to claim 1, wherein one of said operating elements comprises a thermostatic control.

7. Sanitary fitting according to claim 1, wherein the mixing valve is a single-lever mixing valve.

8. Sanitary fitting according to claim 1, constructed as a surface fitting.

9. The sanitary fitting according to claim 1, wherein the shower-flow element defines a water passage through the rosette.

10. The sanitary fitting according to claim 9, wherein a connection between at least one of the mixing valve and a reversing valve, and the water passage through the rosette, is made by a hose.

11. The sanitary fitting according to one of the claim 9 or 10, wherein the water passage leads to a recess for a shower element.

* * * * *